US011526189B2

(12) United States Patent
Huang

(10) Patent No.: US 11,526,189 B2
(45) Date of Patent: Dec. 13, 2022

(54) VOLTAGE REDUCTION CIRCUIT FOR BANDGAP REFERENCE VOLTAGE CIRCUIT

(71) Applicant: REALTEK SEMICONDUCTOR CORP., Hsinchu (TW)

(72) Inventor: Han-Hsiang Huang, Hsinchu (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 52 days.

(21) Appl. No.: 17/334,892

(22) Filed: May 31, 2021

(65) Prior Publication Data

US 2022/0011804 A1 Jan. 13, 2022

(30) Foreign Application Priority Data

Jul. 7, 2020 (TW) ..... 109122846

(51) Int. Cl.
*G05F 3/26* (2006.01)
*G05F 1/46* (2006.01)

(52) U.S. Cl.
CPC ..... *G05F 3/262* (2013.01); *G05F 3/26* (2013.01); *G05F 1/46* (2013.01)

(58) Field of Classification Search
CPC . G05F 3/24; G05F 3/242; G05F 3/245; G05F 3/247; G05F 3/08; G05F 3/26; G05F 3/262; G05F 3/267; G05F 1/10; G05F 1/46; G05F 1/56; G05F 1/565
See application file for complete search history.

(56) References Cited

U.S. PATENT DOCUMENTS 10,775,828 B1 * 9/2020 Lee ..... G05F 3/30
2008/0218253 A1 * 9/2008 Pietri ..... G05F 3/245 327/543
2010/0060345 A1 * 3/2010 Huang ..... G05F 3/30 327/539
2010/0156477 A1 * 6/2010 Chellappa ..... G05F 3/30 327/143
2019/0078940 A1 * 3/2019 Choi ..... G11C 16/3459
2020/0192414 A1 * 6/2020 Mouret ..... G05F 3/267

* cited by examiner

*Primary Examiner* — Thienvu V Tran
*Assistant Examiner* — Shahzeb K Ahmad
(74) *Attorney, Agent, or Firm* — Li & Cai Intellectual Property (USA) Office

(57) ABSTRACT

A voltage reduction circuit for a bandgap reference voltage circuit is provided, and the voltage reduction circuit includes a first transistor, a current mirror circuit, a voltage dividing circuit, an output resistor, and a fourth transistor. The first transistor receives an initial bandgap reference voltage from the bandgap reference voltage circuit. The voltage dividing circuit has a voltage dividing node for outputting a first dividing voltage. The fourth transistor receives the first divided voltage. The current mirror circuit forms a first current on the voltage dividing circuit through the first transistor, and mirrors the first current to the output resistor to form a second current. The voltage dividing circuit and the output resistor each have a first temperature characteristic, the first transistor and the fourth transistor each have a second temperature characteristic, thereby generating, a reference voltage independent of temperature and lower than the initial bandgap reference voltage.

10 Claims, 2 Drawing Sheets

VOLTAGE REDUCTION CIRCUIT FOR BANDGAP REFERENCE VOLTAGE CIRCUIT

CROSS-REFERENCE TO RELATED PATENT APPLICATION

This application claims the benefit of priority to Taiwan Patent Application No. 109122846, filed on Jul. 7, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a voltage reduction circuit for a bandgap reference voltage circuit, and more particularly to a voltage reduction circuit for a bandgap reference voltage circuit that can generate a reference voltage that is independent of temperature and lower than an initial bandgap reference voltage.

BACKGROUND OF THE DISCLOSURE

Generally, a voltage generated by a bandgap reference voltage circuit is around 1.25V. Therefore, if the voltage of the bandgap reference voltage circuit is to be used to generate a temperature-independent reference voltage lower than 1V, a variety of circuits can be used.

For example, buffers and resistors can be used to reduce the bandgap reference voltage. However, size and power consumption of the buffers and the resistors are relatively large. Alternatively, a voltage follower can be used to reduce the bandgap reference voltage, but the reference voltage thus generated has poor temperature characteristic.

Furthermore, voltage dividing resistors are also utilized to directly divide the bandgap reference voltage. However, when resistances are small, the characteristic of the bandgap reference voltage may be affected, or an area occupied by the circuit increases when the resistances are large.

Therefore, generating a temperature-independent reference voltage through a simple circuit by improving circuit designs has become an important issue in the art.

SUMMARY OF THE DISCLOSURE

In response to the above-referenced technical inadequacies, the present disclosure provides a voltage reduction circuit for a bandgap reference voltage circuit that can generate a reference voltage that is independent of temperature and lower than an initial bandgap reference voltage.

In one aspect, the present disclosure provides a voltage reduction circuit for a bandgap reference voltage circuit, the voltage reduction circuit includes a first transistor, a current mirror circuit, a voltage dividing circuit, an output resistor, and a fourth transistor. The first transistor has a first terminal, a second terminal and a third terminal, and the third terminal receives an initial bandgap reference voltage from the bandgap reference voltage circuit. The current mirror circuit includes a second transistor and a third transistor. The second transistor has a first terminal, a second terminal and a third terminal, the first terminal of the second transistor is connected to a voltage source, and the second terminal of the second transistor is connected to the first terminal of the first transistor. The third transistor has a first terminal, a second terminal and a third terminal, the first terminal of the third transistor is connected to the voltage source, the second terminal of the third transistor is connected to an output node, and the third terminal of the third transistor is connected to the third terminal of the second transistor to form the current mirror circuit together with the second transistor. The voltage dividing circuit is connected between the second terminal of the first transistor and a ground terminal, and the voltage dividing circuit has a voltage dividing node for outputting a first dividing voltage. One end of the output resistor is connected to the output node. The fourth transistor has a first terminal, a second terminal and a third terminal, the first terminal of the fourth transistor is connected to another end of the output resistor, the second terminal of the fourth transistor is connected to the ground terminal, and the third end of the fourth transistor is connected to the voltage dividing node for receiving the first dividing voltage. The current mirror circuit is configured to form a first current on the voltage dividing circuit through the first transistor, and mirror the first current to the output resistor through the second transistor and the third transistor at a predetermined magnification to form a second current. The voltage dividing circuit and the output resistor each have a first temperature characteristic, the first transistor and the fourth transistor each have a second temperature characteristic, so as to generate, at the output node, a reference voltage that is independent of temperature and lower than the initial bandgap reference voltage.

Therefore, the voltage reduction circuit for the bandgap reference voltage circuit provided by the present disclosure has a simple circuit structure, and components of the circuit structure are small in power consumption and area, and the circuit structure can be provided without using additional pins and external components, such that a reference voltage that is independent of temperature and lower than the initial bandgap reference voltage can be provided.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
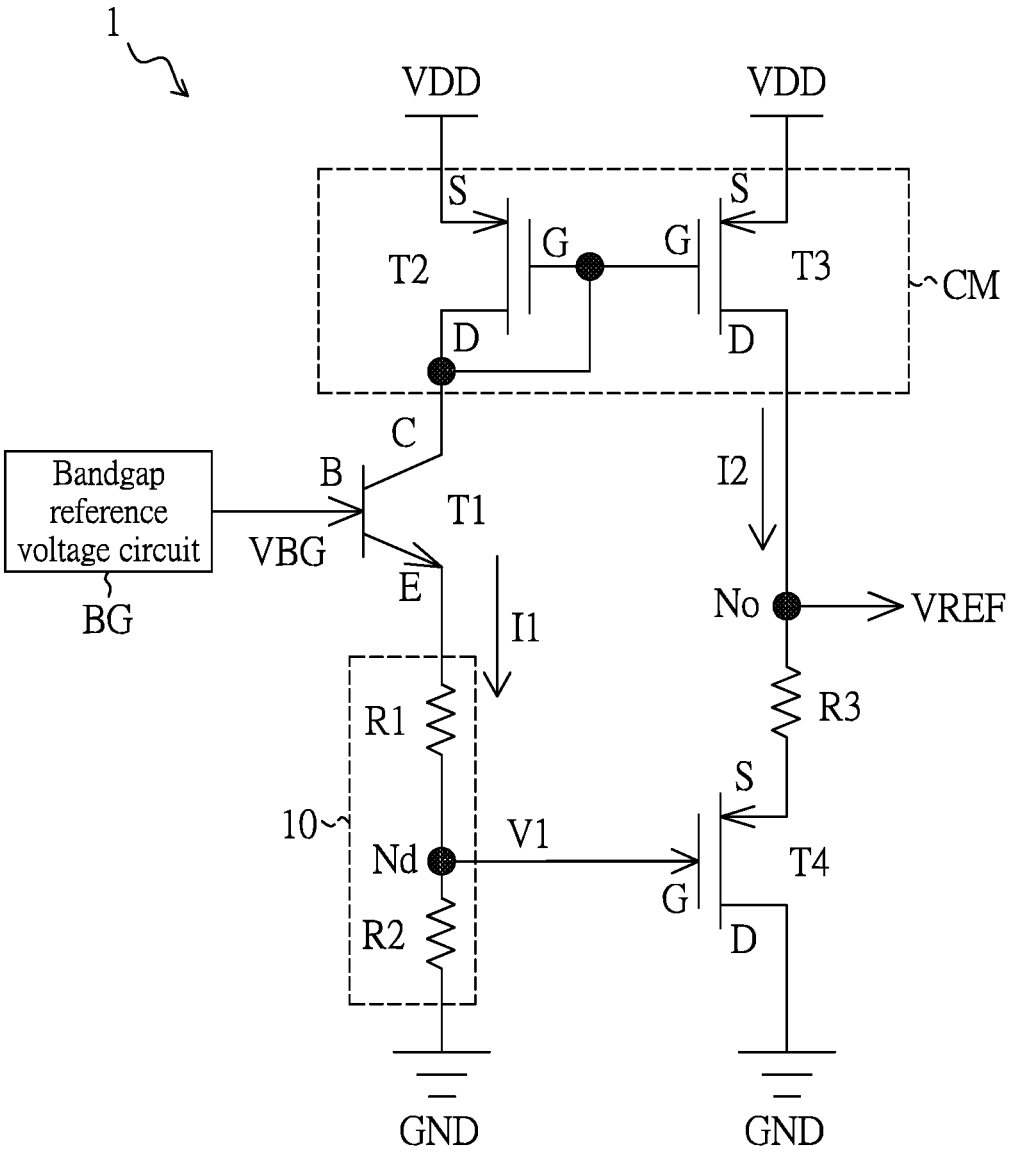
FIG. 1 is a circuit layout diagram of a voltage reduction circuit for a band gap reference voltage circuit according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

FIG. 1 is a circuit layout diagram of a voltage reduction circuit for a band gap reference voltage circuit according to an embodiment of the present disclosure. Reference is made to FIG. 1, in which an embodiment of the present disclosure provides a voltage reduction circuit 1 for a band gap reference voltage circuit, which includes a first transistor T1, a current mirror circuit CM, a voltage divider circuit 10, an output resistor R3, and a fourth transistor T4.

The first transistor T1 has a first terminal, a second terminal, and a third terminal. The third terminal receives an initial band gap reference voltage VBG from a band gap reference voltage circuit BG. In this embodiment, the first transistor T1 is a bipolar field effect transistor (BJT), and a first terminal, a second terminal, and a third terminal of the first transistor T1 are a collector C, an emitter E and a base B of the BJT, respectively. However, the above-mentioned example is only one of the feasible embodiments and is not intended to limit the present disclosure.

The current mirror circuit CM includes a second transistor T2 and a third transistor T3. The second transistor T2 has a first terminal, a second terminal and a third terminal. The first terminal of the second transistor T2 is connected to a voltage source VDD, and the second terminal of the second transistor T2 is connected to the first terminal (i.e., the collector C) of the first transistor T1. The third transistor T3 has a first terminal, a second terminal and a third terminal. The first terminal of the third transistor T3 is connected to the voltage source VDD, the second terminal of the third transistor T3 is connected to an output node No, and the third terminal of the third transistor T3 is connected to the third terminal of the second transistor T2 to form the current mirror circuit CM together with the second transistor T2. However, the present disclosure is not limited to the above-mentioned examples.

In this embodiment, the current mirror circuit CM can be, for example, a P-type current mirror circuit. In other words, the second transistor T2 and the third transistor T3 are both P-type metal oxide semiconductor field effect transistors (PMOS), and the first terminal, the second terminal, the third terminal of the second transistor T2 are a source S, a drain D, and a gate G, respectively. The first terminal, the second terminal, and the third terminal of the third transistor T3 are also a source S, a drain D and a gate G, respectively.

The voltage dividing circuit 10 is connected between the second terminal (i.e., the emitter E) of the first transistor T1 and a ground terminal GND, and the voltage dividing circuit 10 has a voltage dividing node Nd for outputting a first dividing voltage V1. In detail, the voltage dividing circuit 10 can include a first resistor R1 and a second resistor R2. One end of the first resistor R1 is connected to the second terminal (i.e., the emitter E) of the first transistor T1, and the other end of the first resistor R1 is connected to the voltage dividing node Nd. One end of the second resistor R2 is connected to the voltage dividing node Nd, and the other end of the second resistor R2 is connected to the ground terminal GND.

On the other hand, one end of the output resistor R3 is connected to the output node No, and the fourth transistor T4 has a first terminal, a second terminal, and a third terminal. The first terminal of the fourth transistor T4 is connected to another end of the output resistor R3, the second terminal of the fourth transistor T4 is connected to the ground terminal GND, and the third terminal of the fourth transistor T4 is connected to the voltage dividing node Nd to receive the first dividing voltage V1.

In this embodiment, the fourth transistor T4 can be, for example, a P-type metal oxide semiconductor field effect transistor (PMOS), and the first terminal, the second terminal and the third terminal of the fourth transistor T4 are a source S, a drain D, and a gate G of the PMOS, respectively.

Based on a circuit structure of FIG. 1, the current mirror circuit CM can form a first current I1 on the voltage dividing circuit 10 through the first transistor T1, and mirror the first current I1 to the third resistor R3 through the second transistor T2 and the third transistor T3 with a predetermined magnification, such as n times, to form a second current I2. However, the above-mentioned example is only one of the feasible embodiments and is not intended to limit the present disclosure.

Therefore, during an operation of the voltage reduction circuit 1, after a voltage across the third terminal and the second terminal of the first transistor T1 (i.e., a voltage between the base B and the emitter E of the BJT) is subtracted from the initial bandgap reference voltage VBG, the first dividing voltage V1 is then generated by the first resistor R1 and the second resistor R2 in the voltage dividing circuit 10, and the first current I1 can be obtained. Afterwards, the current mirror circuit CM can mirror the first current I1 and generate the second current I2 on the output resistor R3, and a reference voltage VREF generated at the output node No can be obtained by adding the first dividing voltage V1, a voltage between the third terminal and the first terminal of the fourth transistor T4 (i.e., a voltage between the gate G and the source S of the PMOS), and a voltage across the output resistor R3. That is, the reference voltage VREF can be represented by the following equation (1):

$$VREF = \frac{VBG - Vbe}{K} + Vgsp + I2 * R3; \quad \text{Eq(1)}$$

where VBG is the initial bandgap reference voltage, Vbe is the voltage across the third terminal and the second terminal of the first transistor T1 (i.e., the voltage between the base B and the emitter E of the BJT), Vgsp is the voltage between the third terminal and the first terminal of the fourth transistor T4 (i.e., the voltage between the gate G and the source S of the PMOS), I2 is a current value of the second current, R3 is a resistance value of the output resistor, and K is a voltage dividing ratio of the voltage dividing circuit. The voltage dividing ratio K can be represented by the following equation (2):

$$K = \frac{R1 + R2}{R2}. \quad \text{Eq(2)}$$

The second current I2 can be further represented by the following equation (3):

$$I2 = n * \frac{VBG - Vbe}{R1 + R2}; \quad \text{Eq(3)}$$

where n is the predetermined magnification of the current mirror circuit CM.

Therefore, substituting equation (2) into equation (3), the reference voltage VREF can be further obtained as shown in equation (4):

$$VREF = \frac{VBG - Vbe}{K} + Vgsp + n * \frac{VBG - Vbe}{R1 + R2} * R3 = (VBG - Vbe) * \frac{a * n}{K} + Vgsp; \quad \text{Eq(4)}$$

where a is a simplified multiplier, which can be represented by the following equation (5):

$$a = \frac{1}{n} + \frac{R3}{R2}. \quad \text{Eq(5)}$$

It should be noted that the voltage dividing circuit 10 and the output resistor R3 each have a first temperature characteristic, and the first transistor T1 and the fourth transistor T4 each have a second temperature characteristic.

The reasoning behind this design can be referred to in equations (4) and (5). In order to eliminate the effect of temperature in the reference voltage VREF, the present disclosure can use the voltage Vbe between the base B and the emitter E of the BJT and the voltage Vgsp between the gate G and the source S of the fourth transistor T4 having the same temperature characteristic to eliminate the effect of temperature in the items (VBG−Vbe) and Vgsp, and can also use the voltage dividing circuit 10 and the output resistor R3 having the same temperature characteristic to eliminate the effect of temperature in the item(s) R3/R2.

For the first transistor T1 using BJT and the fourth transistor T4 using PMOS, the second temperature characteristic is a negative temperature characteristic. Therefore, an influence caused by the negative temperature characteristic on the voltage Vbe between the base B and the emitter E of the BJT and an influence caused by the negative temperature characteristic on the voltage Vgsp between the gate G and the source S of the PMOS are canceled out in the reference voltage VREF.

On the other hand, for the voltage dividing circuit 10 and the output resistor R3, the first resistor R1 and the second resistor R2 in the voltage dividing circuit 10 can be made of the same material as the output resistor R3. For example, if the first temperature characteristic of each of the first resistor R1, the second resistor R2, and the output resistor R3 is a negative temperature characteristic, an influence caused by the negative temperature characteristic on the output resistance R3 and an influence caused by the negative temperature characteristic on the first resistor R1 and the second resistor R2 are canceled out in the reference voltage VREF, such that the output node No generates the reference voltage VREF that is independent of temperature and lower than the initial bandgap reference voltage VBG. For example, the initial bandgap reference voltage VBG of 1.5V can be designed to be input, and the reference voltage VREF lower than 1V and independent of temperature can be obtained.

Therefore, the voltage reduction circuit for the bandgap reference voltage circuit provided by the present disclosure has a simple circuit structure, in which used components are small in power consumption and area, and the circuit structure can be provided without using additional pins and external components, such that a reference voltage that is independent of temperature and lower than the initial bandgap reference voltage can be provided.

Figure 2:
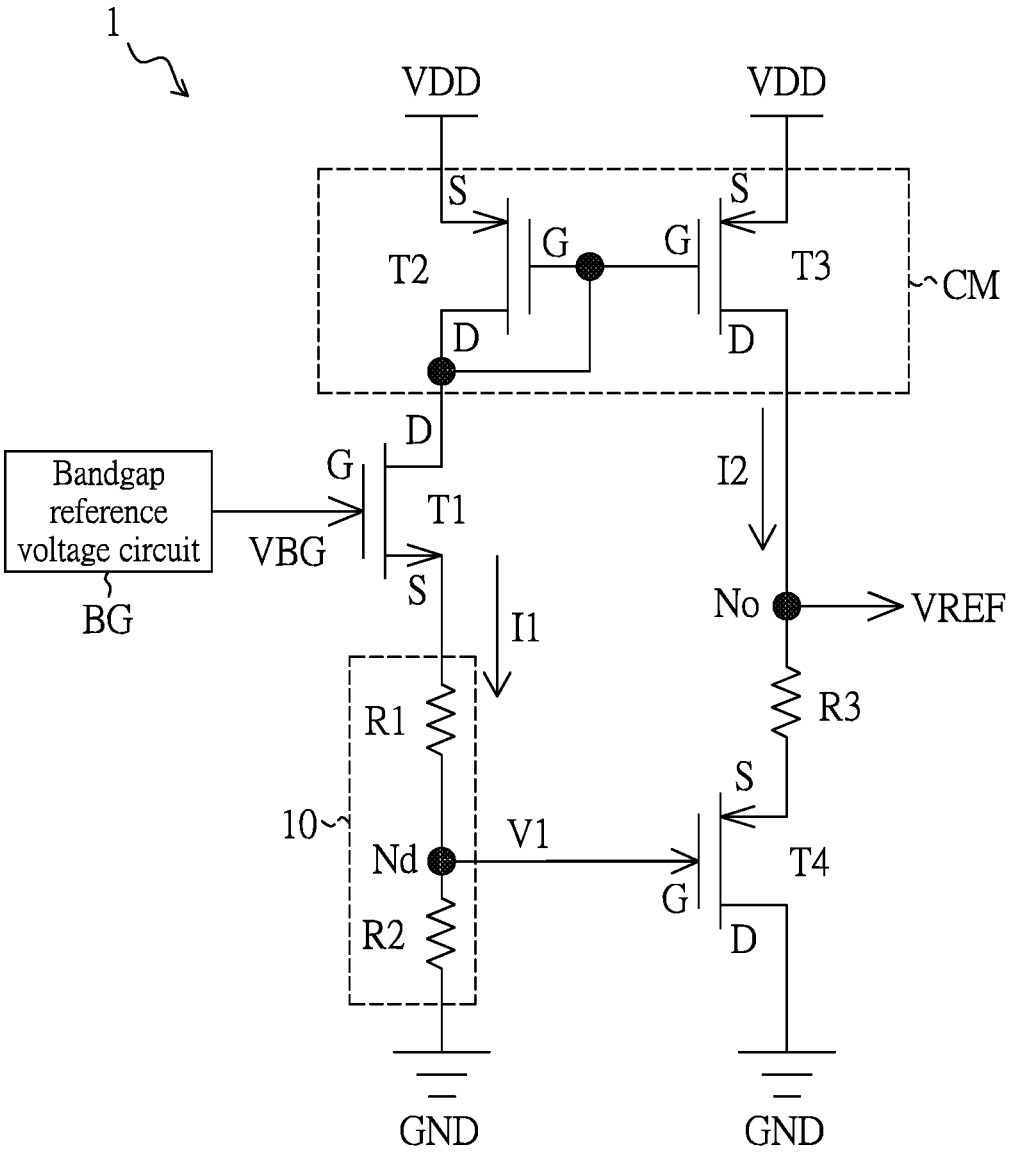
FIG. 2 is a circuit layout diagram of a voltage reduction circuit for a band gap reference voltage circuit according to another embodiment of the present disclosure.

Reference is further made to FIG. 2, which is a circuit layout diagram of a voltage reduction circuit for a band gap reference voltage circuit according to another embodiment of the present disclosure. In this embodiment, similar components are denoted by similar reference numerals, and since most components have been described in the above embodiments, repeated descriptions are omitted hereinafter.

In this embodiment, the first transistor T1 is an N-type metal oxide semiconductor field effect transistor (NMOS), and the first terminal, the second terminal and the third terminal of the first transistor T1 are a drain D, a source S and a gate G of the NMOS, respectively.

Therefore, during an operation of the voltage reduction circuit 1 of FIG. 2, after a voltage across the third terminal and the second terminal of the first transistor T1 (i.e., a voltage between the gate G and the source S of the NMOS) is subtracted from the initial bandgap reference voltage VBG, the first dividing voltage V1 is then generated by the first resistor R1 and the second resistor R2 in the voltage dividing circuit 10, and the first current I1 can be obtained. Afterward, the current mirror circuit CM can mirror the first current I1 and generate the second current I2 on the output resistor R3, and a reference voltage VREF generated at the output node No can be obtained by adding the first dividing voltage V1, a voltage between the third terminal and the first terminal of the fourth transistor T4 (i.e., a voltage between the gate G and the source S of the PMOS), and a voltage across the output resistor R3. However, the above-mentioned example is only one of the feasible embodiments and is not intended to limit the present disclosure.

In other words, the voltage Vbe between the base B and the emitter E of the BJT in the aforementioned equation (4) can be replaced by a voltage Vgsn between the gate G and the source S of the NMOS, and the reference voltage VREF can be represented by the following equation (6):

$$(VBG - Vgsn) * \frac{a * n}{K} + Vgsp. \quad \text{Eq(6)}$$

Therefore, in this embodiment, the voltage Vgsn between the gate G and the source S of the NMOS and the voltage Vgsp between the gate G and the source S of the fourth transistor T4 those have the same temperature characteristics can be utilized to eliminate temperature effect in the terms (VBG−Vgsn) and Vgsp.

For the first transistor T1 using NMOS and the fourth transistor T4 using PMOS, the second temperature characteristic is a negative temperature characteristic. Therefore, an influence caused by the negative temperature characteristic on the voltage Vgsn between the gate G and the source S of the NMOS and an influence caused by the negative temperature characteristic on the voltage Vgsp between the gate G and the source S of the PMOS are canceled out in the reference voltage VREF.

Similarly, this embodiment also uses the voltage dividing circuit 10 and the output resistor R3 that have the same temperature characteristics to eliminate the temperature effect in the item(s) R3/R2, such that the output node No generates the reference voltage VREF that is independent of temperature and lower than the initial bandgap reference voltage VBG.

In conclusion, the voltage reduction circuit for the bandgap reference voltage circuit provided by the present disclosure has a simple circuit structure, and components of the circuit structure are small in power consumption and area, and the circuit structure can be provided without using additional pins and external components, such that a reference voltage that is independent of temperature and lower than the initial bandgap reference voltage can be provided.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A voltage reduction circuit for a bandgap reference voltage circuit, comprising:

a first transistor having a first terminal, a second terminal and a third terminal, wherein the third terminal receives an initial bandgap reference voltage from the bandgap reference voltage circuit;

a current mirror circuit, including:

a second transistor having a first terminal, a second terminal and a third terminal, wherein the first terminal of the second transistor is connected to a voltage source, and the second terminal of the second transistor is connected to the first terminal of the first transistor; and a third transistor having a first terminal, a second terminal and a third terminal, wherein the first terminal of the third transistor is connected to the voltage source, the second terminal of the third transistor is connected to an output node, and the third terminal of the third transistor is connected to the third terminal of the second transistor to form the current mirror circuit together with the second transistor;

a voltage dividing circuit connected between the second terminal of the first transistor and a ground terminal, wherein the voltage dividing circuit has a voltage dividing node for outputting a first dividing voltage;

an output resistor having one end connected to the output node; and a fourth transistor having a first terminal, a second terminal and a third terminal, wherein the first terminal of the fourth transistor is connected to another end of the output resistor, the second terminal of the fourth transistor is connected to the ground terminal, and the third end of the fourth transistor is connected to the voltage dividing node for receiving the first dividing voltage, wherein the current mirror circuit is configured to form a first current on the voltage dividing circuit through the first transistor, and mirror the first current to the output resistor through the second transistor and the third transistor at a predetermined magnification to form a second current, wherein the voltage dividing circuit and the output resistor each have a first temperature characteristic, the first transistor and the fourth transistor each have a second temperature characteristic, so as to generate, at the output node, a reference voltage that is independent of temperature and lower than the initial bandgap reference voltage.

2. The voltage reduction circuit according to claim 1, wherein the fourth transistor is a P-type metal oxide semiconductor field effect transistor (PMOS), and the first terminal, the second terminal and the third terminal of the fourth transistor are a source, a drain and a gate of the PMOS, respectively.

3. The voltage reduction circuit according to claim 2, wherein the first transistor is a bipolar field effect transistor (BJT), and the first terminal, the second terminal and the third terminal are a collector, an emitter and a base of the BJT, respectively.

4. The voltage reduction circuit according to claim 3, wherein the second temperature characteristic is a negative temperature characteristic, and an influence caused by the negative temperature characteristic on a voltage between the base and the emitter of the BJT and an influence caused by the negative temperature characteristic on the voltage between the gate and the source of the PMOS are canceled out in the reference voltage.

5. The voltage reduction circuit according to claim 2, wherein the first transistor is an N-type metal oxide semiconductor field effect transistor (NMOS), and the first terminal, the second terminal and the third terminal of the first transistor are a source, a drain and a gate of the NMOS, respectively.

6. The voltage reduction circuit according to claim 5, wherein the second temperature characteristic is a negative temperature characteristic, and an influence of the negative temperature characteristic on a voltage between the gate and the source of the NMOS and an influence of the negative temperature characteristic on the voltage between the gate and the source of the PMOS are canceled out in the reference voltage.

7. The voltage reduction circuit according to claim 1, wherein the voltage dividing circuit includes:

a first resistor having one end connected to the second terminal of the first transistor, and another end connected to the voltage dividing node; and a second resistor having one end connected to the voltage dividing node, and another end connected to the ground terminal.

8. The voltage reduction circuit according to claim 7, wherein the first resistor, the second resistor, and the output resistor each have the first temperature characteristic.

9. The voltage reduction circuit according to claim 8, wherein the first temperature characteristic is a negative temperature characteristic, and an influence of the negative temperature characteristic on the output resistor and an influence of the negative temperature characteristic on the first resistor and the second resistor are canceled out in the reference voltage.

10. The voltage reduction circuit according to claim 1, wherein the current mirror circuit is a P-type current mirror circuit.

* * * * *